United States Patent [19]

Moon

[11] Patent Number: 4,759,495

[45] Date of Patent: Jul. 26, 1988

[54] VARIABLE VOLUME STACKABLE CONTAINER

[76] Inventor: William P. Moon, 205 Beechwood Dr., Oil City, Pa. 16301

[21] Appl. No.: 93,191

[22] Filed: Sep. 4, 1987

[51] Int. Cl.[4] ..... B65D 5/22; B65D 5/68

[52] U.S. Cl. ..... 229/101; 229/132; 229/40; 229/87 R; 229/23 BT; 206/586; 206/515

[58] Field of Search ..... 229/101, 23 R, 126, 229/132, 141, 40, 87 R, 87 H, 915, DIG. 1, DIG. 11, DIG. 3, 23 BT, 19; 206/586, 594, 575, 579, 821, 492; 220/415, 4 E

[56] References Cited

U.S. PATENT DOCUMENTS

| | | | |
|---|---|---|---|
| 1,270,642 | 6/1918 | Martin, Jr. | 229/40 |
| 2,037,839 | 4/1936 | Wagenseller | 229/33 |
| 2,077,694 | 4/1937 | Hinton | 229/33 |
| 2,249,881 | 7/1941 | Bouchelle | 206/44 |
| 2,316,457 | 4/1943 | Royce | 229/23 |
| 2,556,568 | 6/1951 | Aikman | 229/23 |
| 2,852,178 | 9/1958 | Bolding | 229/34 |
| 2,949,222 | 8/1960 | Coe | 229/41 |
| 3,047,204 | 7/1962 | Wolowicz | 221/41 |
| 3,097,781 | 7/1963 | Masi | 229/23 |
| 3,126,144 | 3/1964 | McCulloch | 229/49 |
| 3,372,855 | 3/1968 | Smith | 229/49 |
| 3,469,761 | 9/1969 | Howell | 229/101 |
| 3,543,994 | 12/1970 | Clark | 229/23 BT |
| 3,598,303 | 8/1971 | Folz | 229/34 |
| 3,727,827 | 4/1973 | Stice | 229/101 |
| 3,913,824 | 10/1975 | Paige | 229/35 |
| 4,162,729 | 7/1979 | Kaiser et al. | 206/592 |
| 4,182,477 | 1/1980 | Paige | 229/37 R |
| 4,235,364 | 11/1980 | Baker | 229/34 R |
| 4,323,187 | 4/1982 | Gillie | 229/101 |
| 4,362,265 | 12/1982 | Williams | 229/109 |
| 4,452,367 | 6/1984 | Wein | 229/33 |

OTHER PUBLICATIONS

Letter and facts relating to submissions of samples to potential vendors and customers.

*Primary Examiner*—Willis Little
*Attorney, Agent, or Firm*—Jeffrey H. Ingerman

[57] ABSTRACT

A variable volume package made from two identical or nearly identical package halves is provided. The package has integral corner posts for stack strength which are formed as the package halves are erected from blanks. The package can be used for a class of articles having two orthogonal dimensions substantially constant among articles in the class, with a third orthogonal dimension varying, by providing overlapping flaps having a length at least equal to one-half the maximum length of the third dimension and at most equal to the minimum length of the third dimension.

38 Claims, 8 Drawing Sheets

VARIABLE VOLUME STACKABLE CONTAINER

BACKGROUND OF THE INVENTION

This invention relates to paperboard containers, particularly to corrugated paperboard containers. More particularly, this invention relates to a variable volume container having increased stack strength.

Corrugated paperboard containers—primarily corrugated boxes—are used by producers of many types of products to store their products and to ship them to customers. During such storage and shipment, the number of boxes that can be stacked in a single vertical column is limited by the stack strength of one box, which is defined as the amount of weight that can be stacked on top of the box before it will deform. For some products it does not matter if the box deforms and transfers at least part of the weight of the boxes above it to its contents. However, for other more fragile types of products it is undesirable for any of the weight of the boxes above to be transferred to the contents. In either case, it is desirable to be able to increase the stack strength of the box as much as possible.

It is known to provide different types of inserts, such as corner posts, in corrugated boxes to increase their stack strength. The inserts have been made of folded corrugated paperboard, of wood, and of polymeric materials such as polystyrene foam. However, use of such inserts adds additional steps to the erection of a box if the inserts are to be added before the box is loaded, or to loading of the box if the inserts are wrapped around the load before the load is inserted into the box. In addition, it is necessary to keep an inventory of inserts in addition to an inventory of boxes.

Most industries produce goods of different sizes or, if they produce small goods, ship their goods in lots of different sizes. However, because of the nature of machinery and tooling, the different size goods frequently have dimensions in common, or the different stacked lots of small goods might have dimensions in common. For example, a manufacturer of household refrigerators may produce several different models of refrigerators of different sizes, but most or all will probably have the same height, and several groups of models may also have the same depth. Nevertheless, the refrigerator manufacturer must have an inventory of boxes of as many different sizes as there are models of refrigerators. Similarly, a manufacturer of light bulbs, all of which are approximately the same size, may ship them in different sized stacked lots, many or all of which have the same horizontal area or the same height, differing only in the other dimensions. Yet the light bulb manufacturer must have an inventory of boxes for each different lot size. Further, in both cases the box must be loaded from one open end and, in the case of a heavy object such as a refrigerator, the box must be lifted, open end down, completely over the top of the object and brought down over the object.

It would be desirable to be able to provide a container which has increased stack strength to reduce or eliminate the need for inserts and the extra step needed to assemble and pack inserts into containers.

It would also be desirable to be able to produce a variable volume container to reduce the inventory of containers that must be kept on hand to pack a variety of articles of different sizes.

It would further be desirable to provide a carton that can be easily erected about large articles.

SUMMARY OF THE INVENTION

It is an object of this invention to provide a container which has increased stack strength to reduce or eliminate the need for inserts and the extra steps needed to assemble and pack inserts into containers.

It is another object of this invention to provide a variable volume container to reduce the inventory of containers that must be kept on hand to pack a variety of articles of different sizes.

It is a further object of this invention to provide a container that is easily erected about large articles.

In accordance with this invention there is provided a package for containing one of a class of loads of substantially similar shape but of varying volume, the varying volume being due substantially to variation, among loads in the class, in one of three orthogonal dimensions between a minimum length and a maximum length, two of the three orthogonal dimensions being substantially invariable. The package has sufficient stack strength to bear at least a substantial portion of the weight of additional loaded packages stacked thereon without assistance from a load within said package.

The package includes a pair of package halves. Each half has a major side having two orthogonal dimensions corresponding to those two of the three orthogonal package dimensions that are substantially invariable. A first pair of side flaps hingedly depends from opposite edges of the major side for folding along two opposite sides of the load. At least a third flap hingedly depends from one of two other opposite sides of the load. Column means is associated with the side flaps and is in a collapsed state before the side flaps are folded alongside the load surface, becoming erected on folding of the flaps alongside the load surfaces. At least one flap of the first pair and of the at least a third flap has a length which exceeds one half of the maximum length and at most equals the minimum length.

The column means provides stacking strength. The package halves can be stored in a flattened condition, whereby in use the major side of one half is placed against one surface of a load and the major side of another half is stacked against the opposite surface of the load, the side flaps being folded alongside surfaces adjacent the two opposite surfaces to enclose desired ones of the adjacent surfaces.

A blank for such package halves is also provided.

In addition, there is provided a packaging system for packaging such a class of goods having a limited plurality of combinations of fixed length in the two substantially invariable dimensions. The system involves maintaining an inventory of package halves having major sides corresponding in size to the limited plurality of combinations of fixed length.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
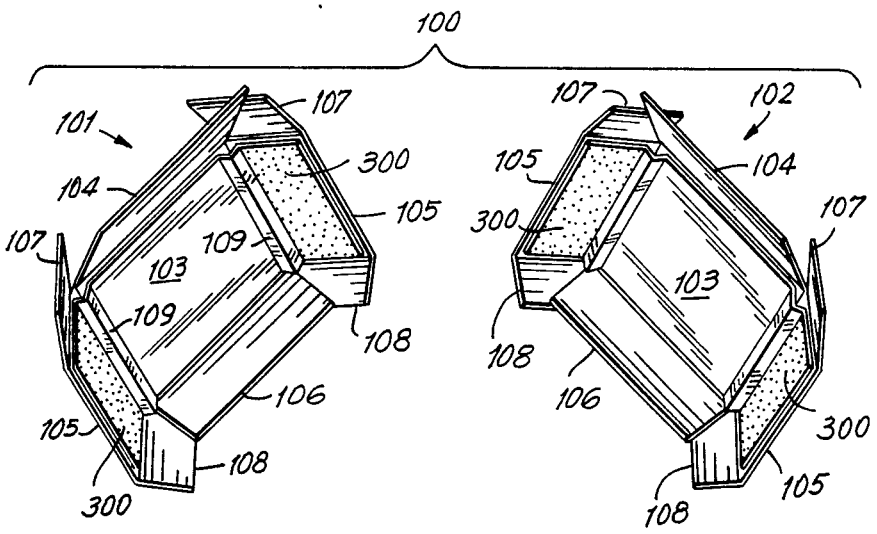
FIG. 1 is an exploded front perspective view of a package according to this invention.

A preferred embodiment of a package according to the present invention is shown in FIGS. 1–4. Paperboard package or box 100 includes two identical independent package halves 101, 102, although, as will be seen below, the package halves need not be identical. Each package half 101, 102 has a major side panel 103, a major top flap 104 hingedly depending from panel 103, two side flaps 105 hingedly depending from panel 103, a major bottom flap 106 hingedly depending from panel 103, two top corner panels 107 hingedly depending from respective side flaps 105, and first and second corner posts 109 where each side flap 105 meets panel 103.

Figure 12:
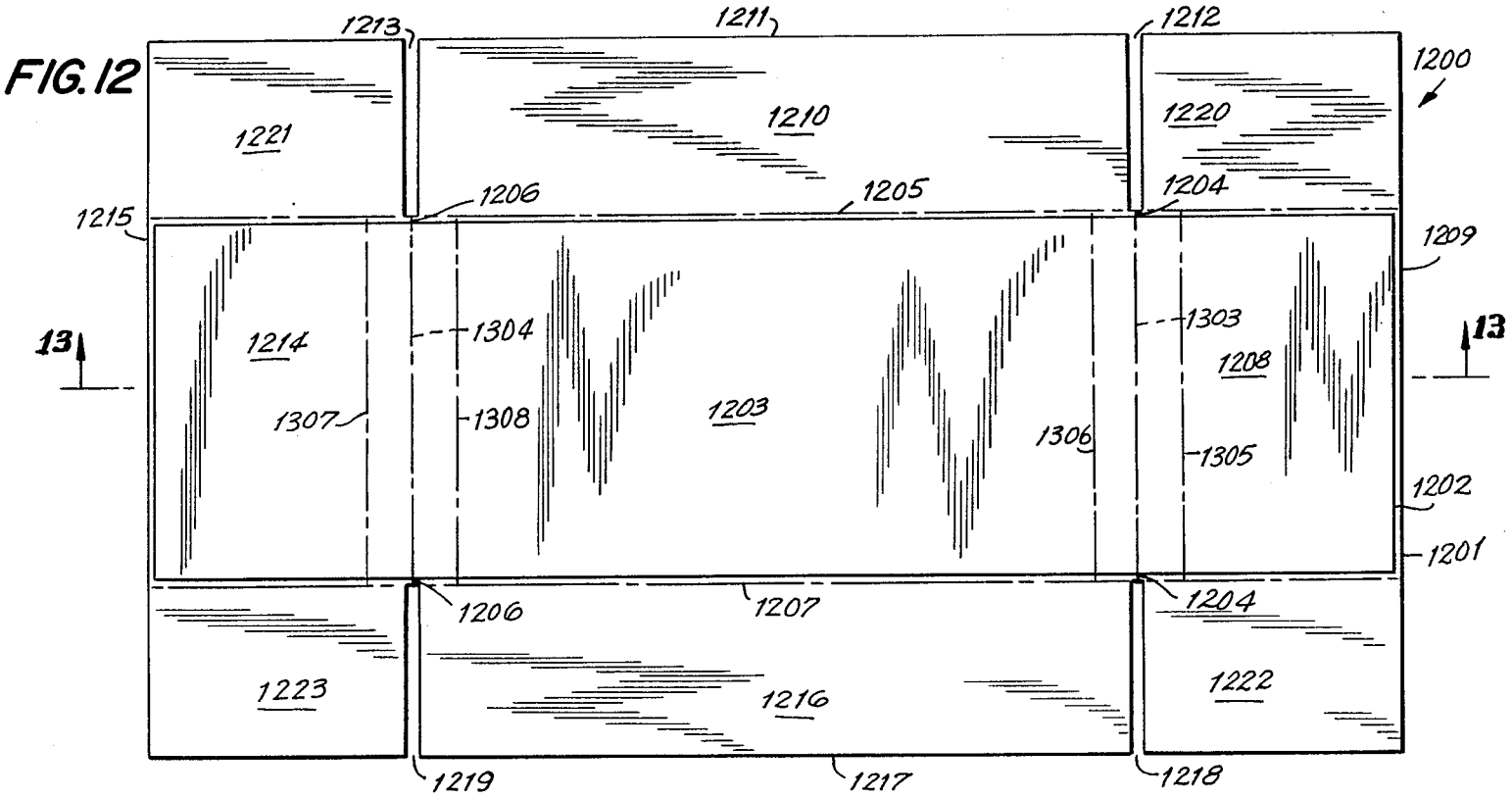
FIG. 12 is a plan view of a blank for the package of FIGS. 1–4.
Figure 13:
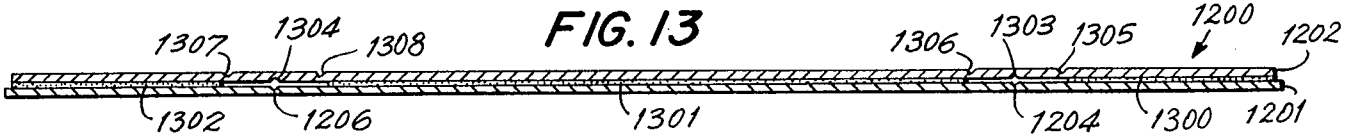
FIG. 13 is a cross-sectional view of the blank of FIG. 12, taken from line 13—13 of FIG. 12.

The blank 1200 from which each package half 101, 102 is erected is shown in FIGS. 12 and 13. As can be seen in FIGS. 12 and 13, blank 1200 is preferably a laminated structure having two laminae 1201, 1202. In the embodiment shown, each lamina is single-wall corrugated paperboard. However, either or both laminae could also be double or triple-wall corrugated paperboard, or have some other number of plies, or they could be made from a completely different material, so long as they can bend at creases or score lines. Each lamina has a first and a second side, on top and bottom, respectively, as viewed in FIG. 13.

Blank 1200 has a major rectangular panel 1203 defined by score lines 1204, 1205, 1206, 1207 in the first side of lamina 1201. First score line 1204 separates major panel 1203 from first side flap panel 1208, which is further defined by first edge 1209 of blank 1200 and by extensions of second and fourth score lines 1205, 1207. Second score line 1205 separates major panel 1203 from second side flap panel 1210, which is further defined by second edge 1211 of blank 1200, and by slits or cutouts 1212, 1213. Third score line 1206 separates major panel 1203 from third side flap panel 1214, which is further defined by third edge 1215 of blank 1200, and by extension of second and fourth score lines 1205, 1207. Fourth score line 1207 separates major panel 1203 from fourth side flap panel 1216, which is additionally defined by fourth edge 1217 of blank 1200, and by slits or cutouts 1218, 1219. A first corner panel 1220 is connected to first side flap panel 1208 by an extension of second score line 1205. A second corner panel 1221 is connected to third side flap panel 1214 by a second extension of second score line 1205. A third corner panel 1222 is connected to first side flap panel 1208 by an extension of fourth score line 1207. A fourth corner panel 1223 is connected to third side flap panel 1214 by a second extension of score line 1207. Each corner panel 1220–1223 is further defined by a respective one of slits or cutouts 1212, 1213, 1218, 1219, and by two of blank edges 1209, 1211, 1215, 1217.

Second lamina 1202 overlies and is substantially coextenive with side flap panels 1208, 1214 and major panel 1203. The second side of lamina 1202 is adhered to the first side of lamina 1201 in areas 1300, 1301, 1302. Second lamina 1202 has two score lines 1303, 1304 in its second side. Score line 1303 is at least as far from edge 1209 as is score line 1204. Score line 1304 is at least as far from edge 1215 as is score line 1206. Second lamina 1202 has four score lines 1305, 1306, 1307, 1308 in its first side. Score line 1305 is between score line 1204 and edge 1209. Score line 1306 is on the other side of score line 1303 from score line 1305 and the distance between score line 1303 and score line 1306 is the same as the distance between score line 1204 and score line 1305. Score line 1307 is between score line 1206 at edge 1215. Score line 1308 is on the other side of score line 1304 from score line 1307 and the distance between score line 1304 and score line 1308 is the same as the distance between score line 1206 and score line 1307. There is no adhesion between laminae 1201, 1202 in the area bounded by score lines 1305, 1306 or in the area bounded by score lines 1307, 1308. The arrangement of adhesive areas 1300–1302 and score lines 1303–1308 is such that when blank 1200 is folded along score lines 1204, 1206, rectangular corner posts 109 are erected. Because in the embodiment shown in FIGS. 12 and 13 score line 1303 overlies score line 1204 and score line 1304 overlies score line 1206, square corner posts are formed. However, as long as the relationships between score lines set forth above in this paragraph are maintained, at least rectangular first square corner posts will be erected even when score lines 1303 and 1304 do not overlap score lines 1204 and 1206, respectively.

Figure 2:
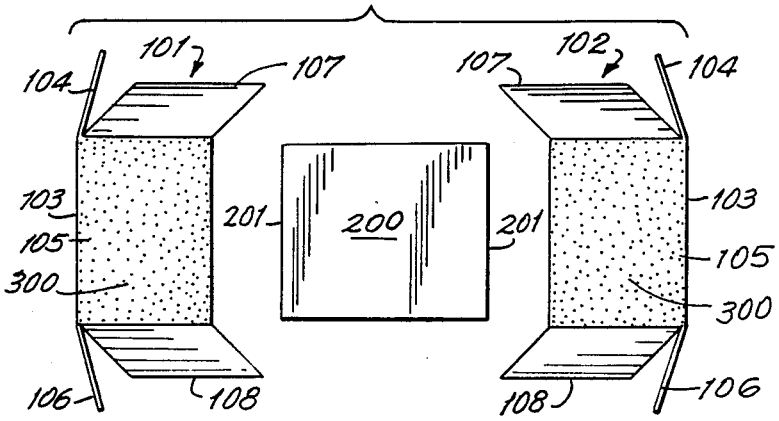
FIG. 2 is an exploded front elevational view of the package of FIG. 1 being assembled about a load.
Figures 3, 4, 5, 6:
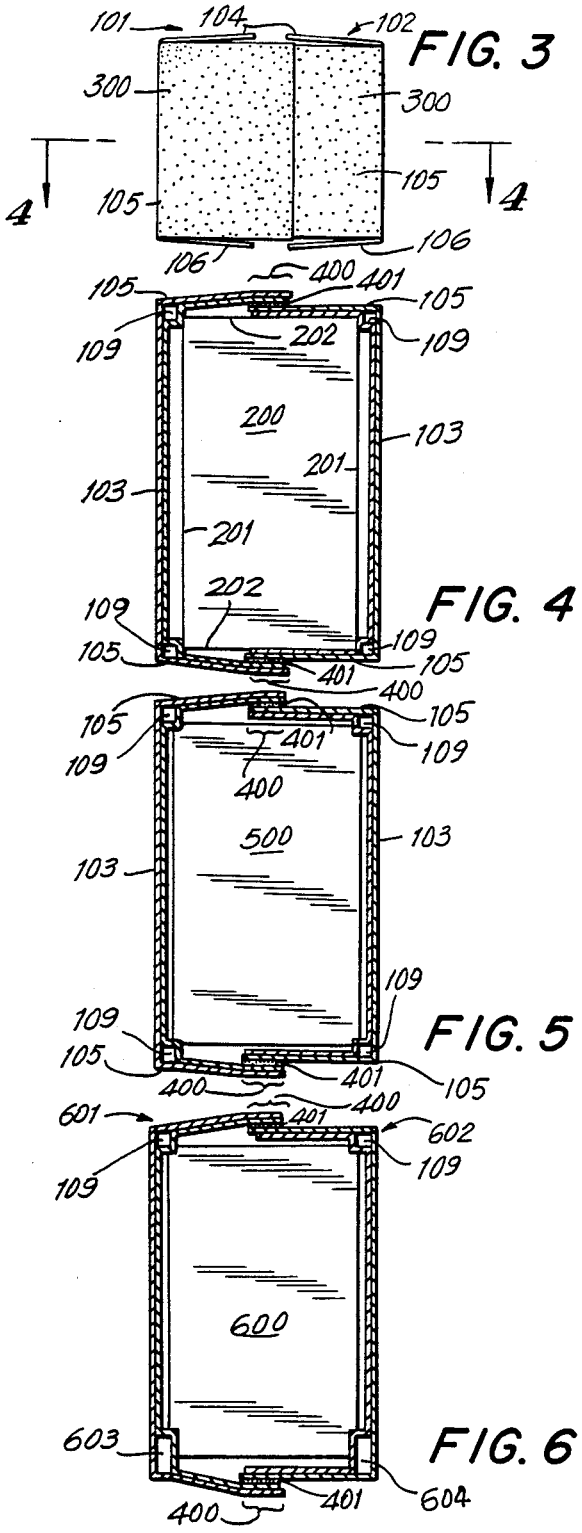
FIG. 3 is a front elevational view of the package of FIG. 2 after assembly about the load.
FIG. 4 is a horizontal cross-sectional view of the package and load of FIG. 3, taken from line 4—4 of FIG. 3.
FIG. 5 is a horizontal cross-sectional view of an alternative embodiment of the package and load of FIG. 4.
FIG. 6 is a horizontal cross-sectional view of another alternative embodiment of the package and load of FIG. 4.

FIGS. 2–4 show a package according to the invention being assembled about a load 200. Sides 201 of load 200 correspond in size to sides 103 of package halves 101, 102. Side flaps 105 are folded alongside adjacent sides 202 of load 200 and fastened to one another as described in more detail below. Top flaps and corner panels 104, 107 and bottom flaps and corner panels 106, 108 are closed and sealed in any conventional manner of closing and sealing the tops and bottoms of packages. The package of the invention is thus easily assembled about any size load, including a refrigerator as referred to above, by applying one package half from either side.

Corner posts 109 become erected on assembly of the package and allow loaded packages to be stacked on one another. The corner posts can be designed so that they bear all the weight of additional packages stacked above a given package (up to a maximum weight limit), or so that they bear a substantial portion, but not all, or even necessarily the majority, of such weight. In either case, the purpose of corner posts 109 is to relieve the load 200 itself from having to bear all of such weight. In one case, load 200 bears none of such weight, while in the other case it bears a portion of such weight. The size of that portion can be adjusted by varying the size of corner posts 109.

As can be seen in FIG. 4, corner posts 109 also serve a partial load isolation function—i.e., they keep sides 201 away from panels 103 of assembled package 100, so that impacts on the outside of panels 103 are not transmitted as readily to load 200. There is no isolation of sides 202. However, if the load has the proper configuration, such as load 500 in FIG. 5, corner posts 109 can isolate all sides 501, 502, 503, 504 of the load.

Figure 14:
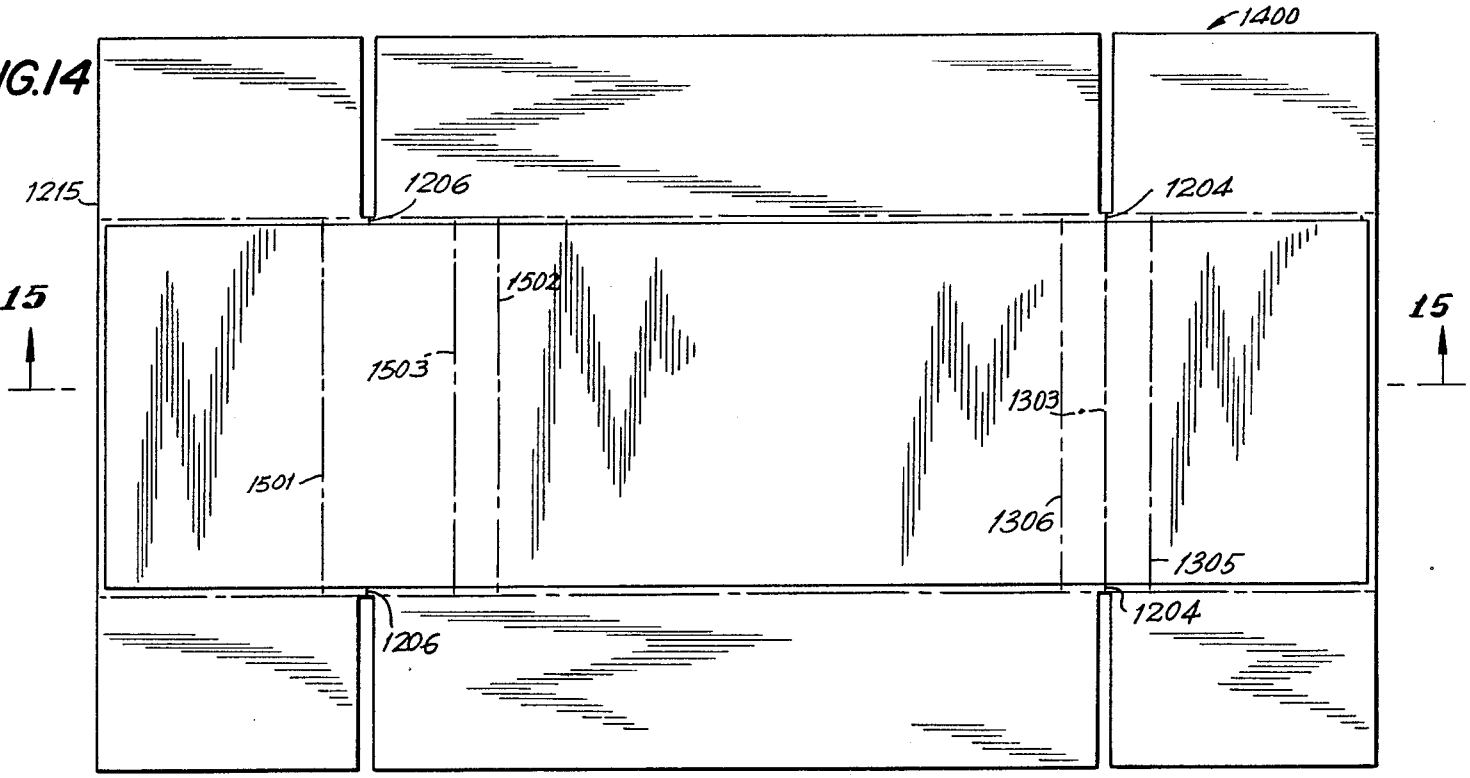
FIG. 14 is a plan view of a blank for the package of FIG. 6.
Figure 15:
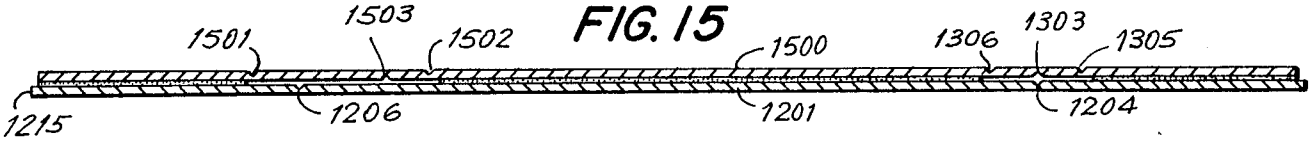
FIG. 15 is a cross-sectional view of the blank of FIG. 14, taken from line 15—15 of FIG. 14.

If such isolation is desired, some loads, such as load 600 of FIG. 6 which has asymmetrical corner indentations, require package halves such as halves 601, 602, which are symmetrical mirror images of one another. FIGS. 14 and 15 show a blank 1400 for package half 601. Package half 602 is the mirror image of package half 601. Thus asymmetrical loads, such as load 600, require that two different, if similar, package halves be kept on hand, as opposed to just one package half for symmetrical loads. Package half 601 forms one square corner post 109 by having on blank 1400 the score lines 1204, 1303, 1305 and 1306 spaced as in blank 1200. Rectangular corner post 603 is formed by having score line 1501 in the first side of lamina 1500 between score line 1206 and edge 1215 of lamina 1201 and score line 1502 and 1503 in the first and second sides of lamina 1500 respectively spaced apart from each other by the distance that separates score lines 1206 and 1501.

Figure 7:
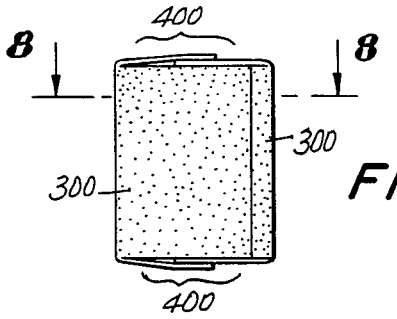
FIG. 7 is a front elevational view of the package of FIG. 1 assembled about a different load.
Figure 8:
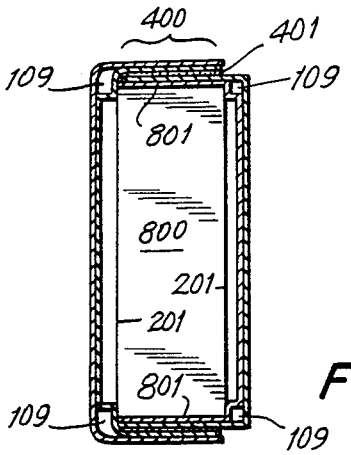
FIG. 8 is a horizontal cross-sectional view of the package and load of FIG. 7 taken from line 8—8 of FIG. 7.

The same package halves 101, 102 that are used for load 200 can be used for a load 800 having sides 201 the same dimensions as sides 201 of load 200, but having sides 801 of different dimensions than sides 202 of load 200, by changing the amount of overlap of flaps 105, as seen in FIGS. 7 and 8. Thus, package 100 can be used for a whole class of articles having sides defined by two identical dimensions, but having other sides that have a third dimension that varies between a minimum length and a maximum length as among articles in the class. The only restriction is that the length of flaps 105 be at most equal to the minimum length and at least equal to half the maximum length so that the overlapping flaps 105 cover a size of any possible length. It is not necessary that the articles be rectangular, as long as they can be defined by two dimensions substantially constant among articles in the class, measured along two orthogonal axes, and by a third dimension, varying among articles in the class, measured along a third orthogonal axis. Nor is it necessary that the "articles" be single articles. Instead, they could be different sized stacks of uniformly-sized smaller articles, so long as the different stacks have two substantially constant dimensions.

Overlapping flaps 105 can be fastened to one another in any desired manner. For example, they can be stapled or sewn together. Adhesive tape can be applied to the outside of the overlap 400. Double-faced adhesive tape or conventional adhesive can be applied under overlap 400 at the time of assembly, forming an adhesive bond 401. Alternatively, the package halves can simply be banded together (with a heavy load, banding may be desirable even if some other means of fastening is used).

However, the preferred method of fastening is to coat flaps 105 with contact adhesive such as that sold under the trademark PRESSEAL ®. This type of adhesive will adhere only to itself. Therefore, because it is not known how much flaps 105 on two halves will overlap, and because the order of folding flaps 105 may be nonuniform from package to package, the contact adhesive 300 is applied to the full extent of both sides of each flap 105. When two coated flaps 105 are folded over a load and pressed toqether, bond 401 is formed.

Blanks according to this method can be formed in any conventional way, such as die-cut methods, slitter/scorer methods, printer/slotter methods, or other methods. Similarly, the contact adhesive can be applied by spraying, extrusion, rolling, or wiping. Application of the adhesive can be done after the blank is formed or, if it is known where flaps 105 will be formed, before the blank is formed.

In addition to applying adhesive to flaps 105, it may be desirable to coat the inner side of the blank. For example, the blank can be coated with foam for cushioning, or a smooth coating, such as polyethylene, can be applied to reduce the abrasiveness of the interior of the package if the load is sensitive to abrasion.

Figure 9:
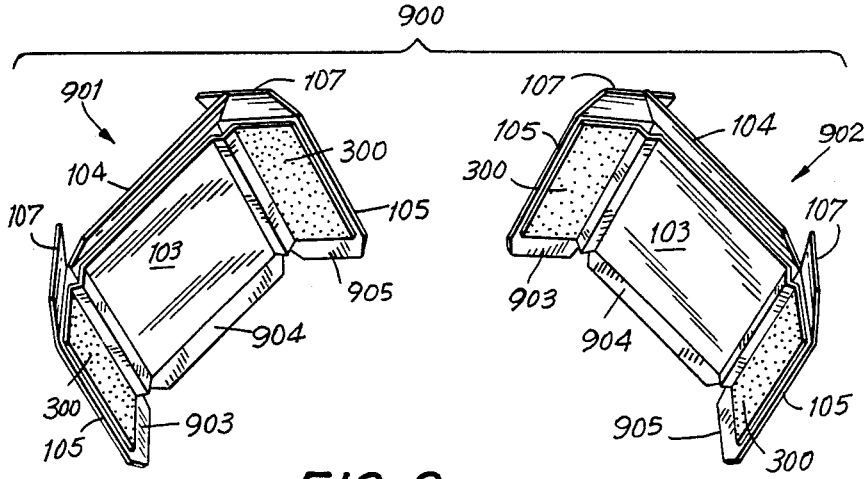
FIG. 9 is an exploded front perspective view of an alternative embodiment of the package of the invention.
Figure 16:
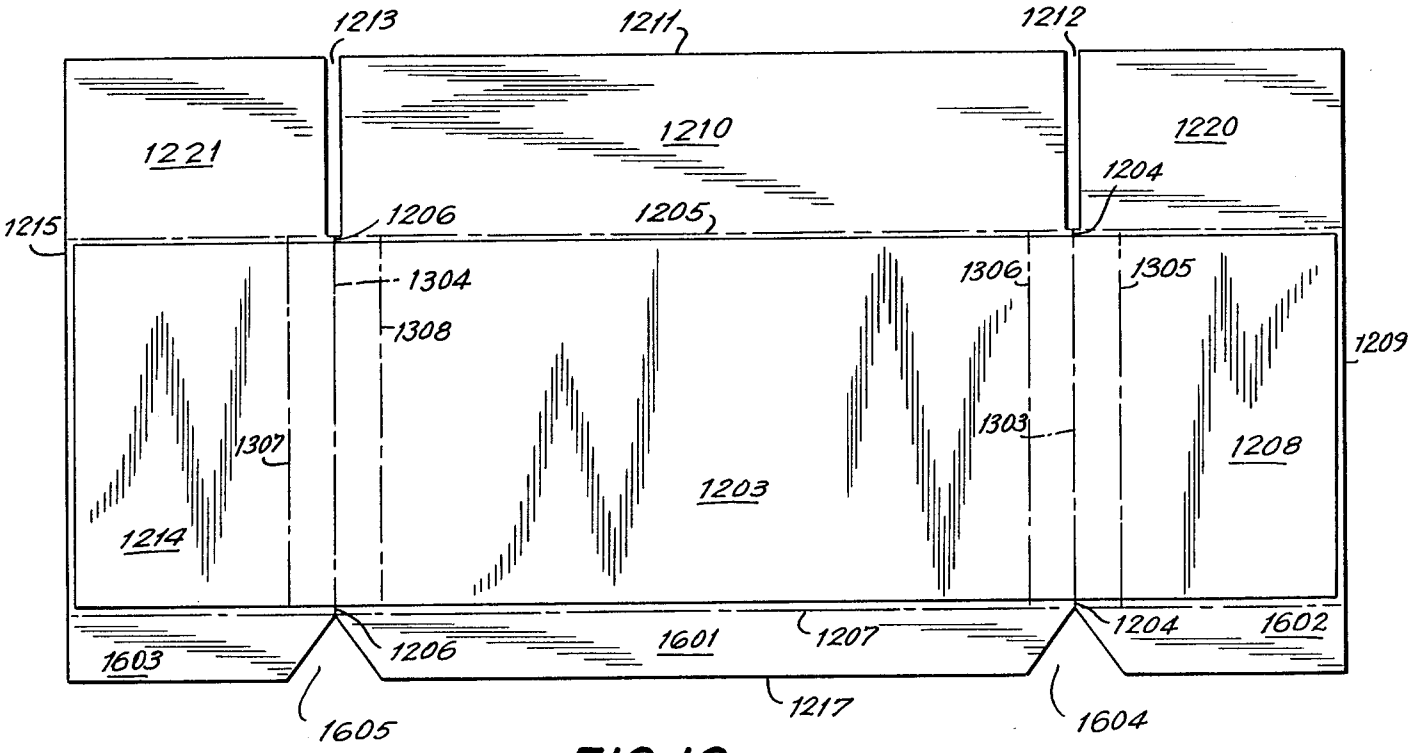
FIG. 16 is a plan view of a blank for the package of FIG. 9.

In the embodiment described above, all surfaces of the load (where rectangular) are covered by the package. However, in some cases it may be desirable that one or more surfaces be partially or completely uncovered. For example, FIG. 9 shows a package 900 that leaves one surface only partially covered. The blank 1600 for halves 901, 902 of package 900 is shown in FIG. 16. Halves 901, 902 are identical to halves 101, 102 except that flaps 903, 904 and 905 are shorter than flaps 106 and corner panels 108. Correspondingly, blank 1600 is identical to blank 1200, except that fourth side flap panel 1601 and third and fourth corner panels 1602 and 1603 are shorter than panels 1216, 1222 and 1223, respectively, and cutouts 1604, 1605 differ in shape from slits or cutouts 1218, 1219.

Figure 10:
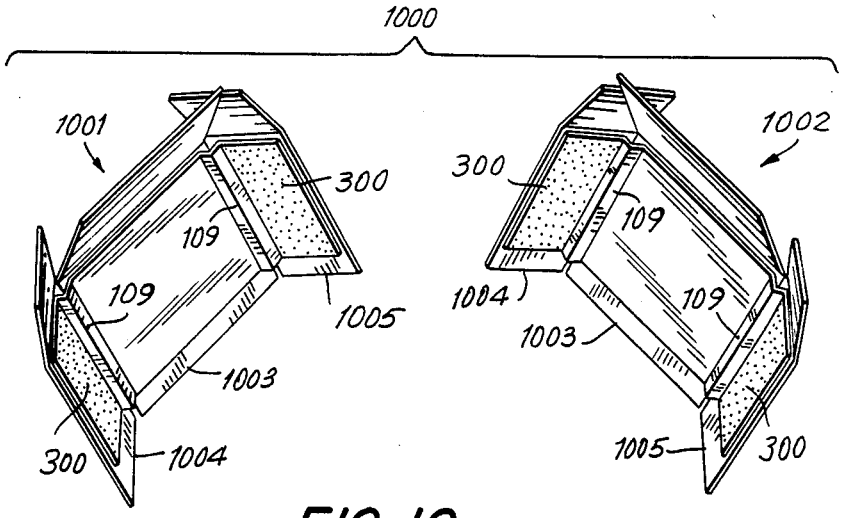
FIG. 10 is an exploded front perspective view of another alternative embodiment of the package of the invention.
Figure 11:
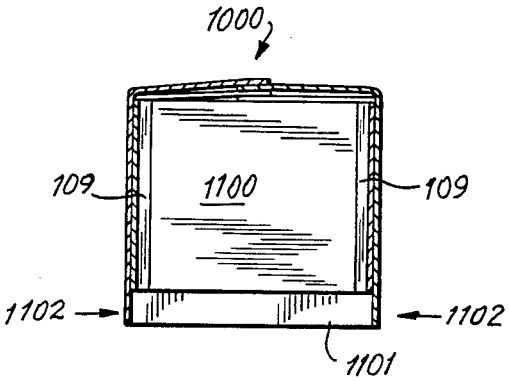
FIG. 11 is a vertical cross-sectional view of the package of FIG. 10 assembled about a load.
Figure 17:
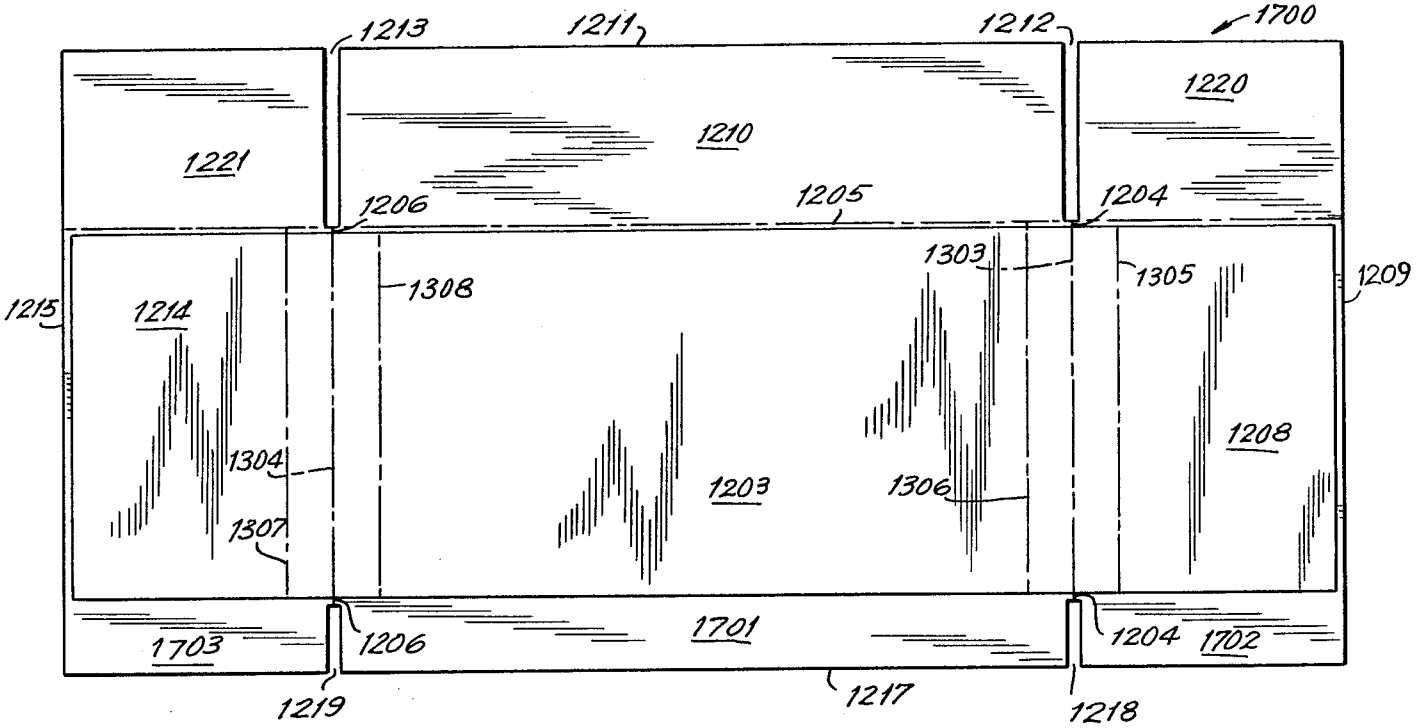
FIG. 17 is a plan view of a blank for the package of FIGS. 10 and 11.

Package 1000 of FIGS. 10 and 11, erected from blank 1700 of FIG. 17, is intended for a load 1100 which comes on a pallet 1101 and is to be packed with pallet 1101 forming the bottom of the package. Thus panels 1003, 1004, 1005 of halves 1001, 1002 extend below the bottoms of corner posts 109 for attachment, as by stapling, to pallet 1101 at points 1102. Blank 1700 is similar to blank 1200, but lacks any score line corresponding to score line 1207 and panels 1701, 1702 and 1703 are shorter than corresponding panels 1216, 1222, 1223.

Thus it is seen that a container is provided which has increased stack strength, has variable volume, and is easily assembled. One skilled in the art will recognize that the present invention can be practiced by other than the described embodiments, which are presented for purposes of illustration and not of limitation, and that the present invention is limited only by the claims which follow.

What is claimed is:

1. A package for containing one load of a class of loads of substantially similar shape but of varying volume, said varying volume due substantially to variation, among loads in said class, in one of three orthogonal dimensions between a minimum length and a maximum length, two of said three orthogonal dimensions being substantially invariable, said package having sufficient stack strength to bear at least a substantial portion of the weight of additional packages stacked thereon without assistance from a load within said package, said package comprising:

a pair of package halves, each of said halves comprising:

a major side having two orthogonal dimensions corresponding to those two of said three orthogonal dimensions that are substantially invariable;

a first pair of side flaps hingedly depending from two opposite edges of said major side for folding alongside two opposite surfaces of said load;

at least a third side flap hingedly depending from one of two other opposite edges of said major side for folding alongside one of two other opposite surfaces of said load; and column means associated with one of said side flaps such that said column means is in a collapsed state before said side flaps are folded alongside said surfaces, said column means becoming erected upon folding of said side flaps alongside said surfaces; wherein at least one flap of said first pair and said at least a third side flap has a length which exceeds one-half said maximum length and is at most equal to said minimum length;

said column means provides said stacking strength; and said halves can be stored in a flattened condition, whereby in use the major side of one of said pair of halves is placed against a first surface of said load, the major side of the other of said pair of halves is placed against a surface of said load, opposite said first surface, and said first pair and said at least a third side flap are folded alongside adjacent surfaces of said load, said side flaps overlapping to enclose desired ones of said adjacent surfaces.

2. The package of claim 1 wherein said hingedly dependent flaps and said major side are formed from one piece of bendable material, said flaps being separated from said major side by first score lines.

3. The package of claim 2 wherein said piece of bendable material is a laminate of two sheets of bendable material, said first score lines being in one of said sheets, the other of said sheets being adhered to said one of said sheets but being adhesive-free in a region adjacent those of said first score lines which form vertical corners of said package, said other of said sheets having second score lines in said adhesive-free area, whereby said column means is erected by folding of said piece of bendable material along said first score lines.

4. The package of claim 1 wherein both flaps of said first pair of side flaps and said third side flap have a length which exceeds one-half said maximum length and is at most equal to said minimum length, said third flap being the only flap depending from either of said two other opposite edges of said major side, whereby one surface of said load is completely exposed by said package.

5. The package of claim 1 wherein said third side flap is one of a second pair of side flaps hingely depending from said two other opposite edges of said major side.

6. The package of claim 5 wherein both flaps of both said first and second pairs of side flaps have a length which exceeds one-half said maximum length and is at most equal to said minimum length, whereby all surfaces of said load are covered by said package.

7. The package of claim 5 wherein both flaps of one of said first and second pairs of side flaps and one flap of the other of said first and second pairs of side flaps have a length which exceeds one-half of said maximum length and is at most equal to said minimum length, the other flap of said other of said first and second pairs of side flaps having a length less than the length of said one flap of said other of said first and second pairs of side flaps, whereby one surface of said load is at most partially covered by said package.

8. A blank for a package half, said package half being an independent half of a package for containing one load of a class of loads of substantially similar shape but of varying volume, said varying volume due substantially to variation, among loads in said class, in one of three orthogonal dimensions between a minimum length and a maximum length, two of said three orthogonal dimensions being substantially invariable, said package having sufficient stack strength to bear at least a substantial portion of the weight of additional packages stacked thereon without assistance from a load within said package, said blank comprising:

a first lamina and a second lamina, said first lamina having first and second sides and comprising:

a major rectangular panel having first, second, third and fourth boundaries, said boundaries being defined by score lines on the first side thereof, said first and third score lines being parallel to one another and being substantially equal in length to one of said substantially invariable dimensions, said second and fourth boundaries being substantially parallel to one another and substantially perpendicular to said first and third boundaries and being substantially equal in length to the other of said substantially invariable dimensions, said first, second and third boundaries being formed by first, second and third score lines, respectively;

a first side panel connected to said major panel along said first score line and being further defined by first extensions of said second and fourth score lines and by a first edge of said blank;

a second side panel connected to said major panel along said second score line and being further defined by first and second cuts and by a second edge of said blank;

a third side panel connected to said major panel along said third score line and being further defined by second extensions of said second and fourth score lines and by a third edge of said blank;

a first corner panel connected to said first side panel by said first extension of said second score line and being further defined by said first cut and by said first and second edges of said blank; and a second corner panel connected to said third side panel by said second extension of said second score line and being further defined by said second cut and by said second and third edges of said blank; and said second lamina being coextensive with said major panel and with said first and third side panels, and having first and second sides, said second side of said second lamina contacting said first side of said first lamina, said second lamina having:

a fifth score line in said first side thereof, between said first score line and said first edge and spaced by a first distance from said first score line;

a sixth score line in said second side thereof spaced from said fifth score line by a second distance, said second distance being at least equal to said first distance, said fifth score line being between said sixth score line and said first edge;

a seventh score line in said first side thereof spaced from said sixth score line by said first distance and being further from said first score line than is said sixth score line, said sixth score line being between said fifth and seventh score lines;

an eighth score line in said first side thereof between said third edge and said third score line and spaced by a third distance from said third score line;

a ninth score line in said second side thereof spaced from said eighth score line by a fourth distance, said fourth distance being at least equal to said third distance, said eight score line being between said ninth score line and said third page; and a tenth score line in said first side thereof spaced from said ninth score line by said third distance and being further from said third score line than is said ninth score line, said ninth score line being between said eight and tenth score lines; and said first and second laminae are adhered to one another between said first edge and said fifth score line, between said seventh and eighth score lines, and between said tenth score line and said third edge: whereby when said blank is folded along said first score line, rectangular column means having orthogonal dimensions equal to said first and second distances are formed, and when said blank is folded along said third score line, rectangular column means having orthogonal dimensions equal to said third and fourth distances are formed.

9. The blank of claim 8 wherein said fourth boundary is formed by a fourth score line; said blank further comprising:

a fourth side panel connected to said major panel along said fourth score line and being further defined by third and fourth cuts and by a fourth edge of said blank;

a third corner panel connected to said first side panel by a first extension of said fourth score line and being further defined by said third cut and by said first and fourth edges of said blank; and a fourth corner panel connected to said third side panel by a second extension of said fourth score line and being further defined by a fourth cut and by said third and fourth edges of said blank.

10. The blank of claim 9 wherein the distance from said first score line to said first edge, the distance from said third score line to said third edge, and at least one of (a) the distance from said second score line to said second edge, and (b) the distance from said fourth score line to said fourth edge, are equal to one another, exceed one-half said maximum length, and are at most equal to said minimum length.

11. The blank of claim 10 wherein the distances from said first score line to said first edge, said second score line to said second edge, said third score line to said third edge, and said fourth score line to said fourth edge are equal to one another.

12. A packaging system for packaging a class of loads of substantially similar shape but of varying volume, said varying volume due substantially to variation, among loads in said class, in one of three orthogonal dimensions between a minimum length and a maximum length, two of said three orthogonal dimensions appearing, among said class of loads, in a limited plurality of combinations of fixed lengths, said system comprising:

independent package halves, each of said halves comprising:

a major side having two orthogonal dimensions corresponding to one of said limited plurality of combinations of fixed lengths;

a first pair of side flaps hingedly depending from two opposite edges of said major side for folding alongside two opposite surfaces of one of said loads; and at least a third side flap hingedly depending from one of two other opposite edges of said major side for folding alongside one of two other opposite surfaces of said one of said loads; wherein at least one flap of said first pair and said at least a third side flap has a length which exceeds one-half said maximum length and is at most equal to said minimum length; and said halves can be stored in a flattened condition, whereby in use the major side one of said pair of halves is placed against a first surface of said one of said loads, the major side of the other of said pair of halves is placed against a surface of said one of said loads opposite said first surface, and said first pair and said at least a third side flap are folded alongside adjacent surfaces of said one of said loads, said side flaps overlapping to enclose desired ones of said adjacent surfaces.

13. The packaging system of claim 12 wherein each of said halves further comprises column means associated with said side flaps such that said column means is in a collapsed state before said side flaps are folded alongside said surfaces, said column means becoming erected upon folding of said side flaps along said surfaces, whereby said column means provides sufficient stacking strength to bear the weight of additional packages stacked on a package formed from said halves without the assistance of a load contained therein.

14. The packaging system of claim 12 wherein said hingedly dependent flaps and said major side are formed from one piece of bendable material, said flaps being separated from said major side by first score lines.

15. The packaging system of claim 14 wherein said piece of bendable material is a laminate of two sheets of bendable material, said first score lines being in one of said sheets, the other of said sheets being adhered to said one of said sheets but being adhesive-free in a region adjacent those of said first score lines which form vertical corners of said package, said other of said sheets having second score lines in said adhesive-free area, whereby said column means is erected by folding of said piece of bendable material along said first score lines.

16. The packaging system of claim 12 wherein said both flaps of said first pair of side flaps and said third side flap have a length which exceeds one-half said maximum length and is at most equal to said minimum length, said third flap being the only flap depending from either of said two other opposite edges of said major side, whereby one surface of said one of said loads is completely exposed by said package.

17. The packaging system of claim 12 wherein said third side flap is one of a second pair of side flaps hingedly depending from said two other opposite edges of said major side.

18. The packaging system of claim 17 wherein both flaps of both said first and second pairs of side flaps have a length which exceeds one-half said maximum length and is at most equal to said minimum length, whereby all surfaces of said one of said loads are covered by said package.

19. The packaging system of claim 17 wherein both flaps of one of said first and second pairs of side flaps and one flap of the other of said first and second pairs of side flaps have a length which exceeds one-half of said maximum length and is at most equal to said minimum length, the other flap of said other of said first and second pairs of side flaps having a length less than the length of said one flap of said other of said first and second pairs of side flaps, whereby one surface of said one of said loads is at most partially covered by said package.

20. A package for containing one load of a class of loads of substantially similar shape but of varying volume, said varying volume due substantially to variation, among loads in said class, in one of three orthogonal dimensions between a minimum length and a maximum length, two of said three orthogonal dimensions being substantially invariable, said package comprising:

a pair of package halves, each of said halves being for placing against a side of said load and comprising:

a major side having two orthogonal dimensions corresponding to those two of said three orthogonal dimensions that are substantially invariable;

a first pair of side flaps hingedly depending from a first pair of opposite edges of said major side, and at least a third flap hingedly depending from at least one edge of a second pair of opposite edges of said major side, said flaps being for folding alongside respective surfaces of said load; and column means associated with one of said pairs of side flaps for providing said package with sufficient stack strength to bear at least a substantial portion of the weight of additional packages stacked thereon without assistance from a load within said package, said column means being in a collapsed state before said side flaps are folded alongside said surfaces, said column means becoming erected upon folding of said side flaps alongside said surfaces; wherein at least one flap of said first pair and said at least a third of side flap has a length which exceeds one-half said maximum length and is at most equal to said minimum length.

21. The package of claim 20 wherein said hingedly dependent flaps and said major side are formed from one piece of bendable material, said flaps being separated from said major side by first score lines.

22. The package of claim 21 wherein said piece of bendable material is a laminate of two sheets of bendable material, said first score lines being in one of said sheets, the other of said sheets being adhered to said one of said sheets but being adhesive-free in a region adjacent those of said first score lines which form vertical corners of said package, said other of said sheets having second score lines in said adhesive-free area, whereby said column means is erected by folding of said piece of bendable material along said first score lines.

23. The package of claim 20 wherein both flaps of said first pair of side flaps and said third side flap have a length which exceeds one-half said maximum length and is at most equal to said minimum length, said third flap being the only flap depending from either edge of said second pair of opposite edges of said major side, whereby one surface of said load is completely exposed by said package.

24. The package of claim 20 wherein said third side flap is one of a second pair of side flaps hingedly depending from said second pair of opposite edges of said major side.

25. The package of claim 24 wherein both flaps of both said first and second pairs of side flaps have a length which exceeds one-half said maximum length and is at most equal to said minimum length, whereby all surfaces of said load are covered by said package.

26. The package of claim 24 wherein both flaps of one of said first and second pairs of side flaps and one flap of the other of said first and second pairs of side flaps have a length which exceeds one-half of said maximum length and is at most equal to said minimum length, the other flap of said other of said first and second pairs of side flaps having a length less than the length of said one flap of said other of said first and second pairs of side flaps, whereby one surface of said load is at most partially covered by said package.

27. A blank for a package half, said package half being half of a package for containing one load of a class of loads of substantially similar shape but of varying volume, said varying volume due substantially to variation, among loads in said class, in one of three orthogonal dimensions between a minimum length and a maximum length, two of said three orthogonal dimensions being substantially invariable, said package having sufficient stack strength to bear at least a substantial portion of the weight of additional packages stacked thereon without assistance from a load within said package, said blank comprising:

a first lamina and a second lamina, said first lamina having first and second sides and comprising:

a major rectangular panel having first, second, third and fourth boundaries, said boundaries being defined by score lines on the first side thereof, said first and third boundaries being parallel to one another and being substantially equal in length to one of said substantially invariable dimensions, said second and fourth boundaries being substantially parallel to one another and substantially perpendicular to said first and third boundaries and being substantially equal in length to the other of said substantially invariable dimensions, said first, second and third boundaries being formed by first, second and third score lines, respectively;

first, second and third side panels connected to said major panel along said first, second and third score lines and being further defined by first, second, third and fourth edges of said blank and, in the case of said first and third side panels, by extension of said second score line, and, in the case of said second side panel, by first and second cuts; and first and second corner panels connected to said first and third side panels by said extensions of said second score line and being further defined by said cuts and by said first, second and third edges of said blank; and said second lamina being coextensive with said major panel and with said first and third side panels, and having first and second sides, said second side of said second lamina contacting said first side of said first lamina, said second lamina having:

fifth, sixth, seventh, eighth, ninth and tenth score lines in said first and second sides thereof adjacent said first and third score lines; wherein said first and second laminae are adhered to one another other than adjacent said first and third score lines; whereby when said blank is folded along said first and third score lines, rectangular column means are formed.

28. The blank of claim 27 wherein said fourth boundary is formed by a fourth score line; said blank further comprising:

a fourth side panel connected to said major panel along said fourth score line and being further defined by third and fourth cuts and by a fourth edge of said blank; and third and fourth corner panels connected to said first and third side panels by extensions of said fourth score line and being further defined by said third and fourth cuts and by said first, third and fourth edges of said blank.

29. The blank of claim 28 wherein the distance from said first score line to said first edge, the distance from said third score line to said third edge, and at least one of (a) the distance from said second score line to said second edge, and (b) the distance from said fourth score line to said fourth edge, are equal to one another, exceed one-half said maximum length, and are at most equal to said minimum length.

30. The blank of claim 29 wherein the distances from said first score line to said first edge, said second score line to said second edge, said third score line to said third edge, and said fourth score line to said fourth edge are equal to one another.

31. A packaging system for packaging a class of loads of substantially similar shape but of varying volume, said varying volume due substantially to variation, among loads in said class, in one of three orthogonal dimensions between a minimum length and a maximum length, two of said three orthogonal dimensions appearing, among said class of loads, in a limited plurality of combinations of fixed lengths, said system comprising:

package halves, each of said halves being for placing against a side of said load and comprising:

a major side having two orthogonal dimensions corresponding to one of said limited plurality of combinations of fixed lengths; and a first pair of side flaps hingedly depending from a first pair of opposite edges of said major side, and at least a third side flap hingedly depending from at least one edge of a second pair of opposite edges of said major side, said flaps being for folding alongside respective pairs of opposite surfaces of one of said loads; wherein at least one flap of said first pair and said at least a third side flap has a length which exceeds one-half said maximum length and is at most equal to said minimum length.

32. The packaging system of claim 31 wherein each of said halves further comprises column means associated with said side flaps such that said column means is in a collapsed state before said side flaps are folded alongside said surfaces, said column means becoming erected upon folding of said side flaps along said surfaces, whereby said column means provides sufficient stacking strength to bear the weight of additional packages stacked on a package formed from said halves without the assistance of a load contained therein.

33. The packaging system of claim 31 wherein said hingedly dependent flaps and said major side are formed from one piece of bendable material, said flaps being spaced from said major side by first score lines.

34. The packaging system of claim 33 wherein said piece of bendable material is a laminate of two sheets of bendable material, said first score lines being in one of said sheets, the other of said sheets being adhered to said one of said sheets but being adhesive-free in a region adjacent those of said first score lines which form vertical corners of said package, said other of said sheets having second score lines in said adhesive-free area, whereby said column means is erected by folding of said piece of bendable material along said first score lines.

35. The packaging system of claim 31 wherein both flaps of said first pair of side flaps and said third side flap have a length which exceeds one-half said maximum length and is at most equal to said minimum length, said third flap being the only flap depending from either of said two other opposite edges of said major side, whereby one surface of said one of said loads is completely exposed by said package.

36. The packaging system of claim 31 wherein said third side flap is one of a second pair of side flaps hingedly depending from said two other opposite edges of said major side.

37. The packaging system of claim 36 wherein both flaps of both said first and second pairs of side flaps have a length which exceeds one-half said maximum length and is at most equal to said minimum length, whereby all surfaces of said load are covered by said package.

38. The packaging system of claim 36 wherein both flaps of one of said first and second pairs of side flaps and one flap of the other of said first and second pairs of side flaps have a length which exceeds one-half of said maximum length and is at most equal to said minimum length, the other flap of said other of said first and second pairs of side flaps having a length less than the length of said one flap of said other of said first and second pairs of side flaps, whereby one surface of said load is at most partially covered by said package.

* * * * *